United States Patent [19]

Santo

[11] Patent Number: 4,491,993

[45] Date of Patent: Jan. 8, 1985

[54] MECHANISM FOR MAINTAINING THE SHAPE OF A FLOATATION SLEEP SYSTEM

[76] Inventor: Philip J. Santo, 12 Mountain Rd., Rochester, N.Y. 14625

[21] Appl. No.: 450,021

[22] Filed: Dec. 15, 1982

[51] Int. Cl.[3] ..... A47C 27/08

[52] U.S. Cl. ..... 5/451; 5/452

[58] Field of Search ..... 5/451, 452, 449, 450, 5/455, 496

[56] References Cited

U.S. PATENT DOCUMENTS

| | | | |
|---|---|---|---|
| 4,057,862 | 11/1977 | La Bianco | 5/451 |
| 4,245,363 | 1/1981 | Callaway | 5/451 |
| 4,334,331 | 6/1982 | Santo | 5/451 |
| 4,371,998 | 2/1983 | Callaway | 5/451 |

*Primary Examiner*—Alexander Grosz

*Attorney, Agent, or Firm*—Lawrence P. Kessler

[57] ABSTRACT

Mechanism for maintaining the shape of a floatation sleep system, such system including a bladder having flexible walls defining a chamber adapted to be filled with fluid and a marginal perimeter edge support for such bladder. The shape maintaining mechanism comprises a sheet of flexible, dimensionally stable material. The sheet is attached to the underside of the bladder along a substantial portion of opposed marginal edges so that it extends, in intimate contact, from one edge, around the adjacent marginal perimeter support, across the top portion of the bladder, around the opposite marginal perimeter support to the other edge. Such sheet is thus constrained to oppose the fluid forces on the marginal perimeter support and maintain the shape of the floatation sleep system.

5 Claims, 4 Drawing Figures

MECHANISM FOR MAINTAINING THE SHAPE OF A FLOATATION SLEEP SYSTEM

BACKGROUND OF THE INVENTION

This invention relates generally to floatation sleep systems, and more particularly to a mechanism for maintaining the shape of a floatation sleep system.

Floatation sleep systems, commonly referred to as waterbeds, have become a popular alternative to conventional bedding. Such popularity is due to the fact that waterbeds provide totally balanced body support which has been found to induce a superior state of relaxation. The first waterbeds were free standing, flexible bladders filled with water. However, since the free standing bladder was flexible in all directions, it was necessary that it have a vertical dimension (height) to prevent "bottoming out" when the body was supported on the bladder. This height made it awkward to get on and off the bladder, and the fact that the side walls of the bladder were flexible made sitting on the edge difficult. Therefore, a rigid frame was added, the frame being located around the lateral marginal edges of the flexible bladder. While the frame supported the bladder to maintain a desired height and prevent bottoming out, sitting on the edge and getting in and out of the waterbed over the frame was still uncomfortable.

In order to improve the comfort of the waterbed, the frame was replaced by compressible air chambers along the lateral marginal edges of the flexible bladder, such as shown in U.S. Pat. Nos. 3,778,852 issued Dec. 18, 1973 in the name of Penn et al and 4,079,473 issued Mar. 21, 1978 in the name of Philips, for example. The air chamber provided comfort when entering and exiting the bed and when sitting on the edge thereof, and in addition maintained the fluid bladder at a desired height to prevent bottoming out. However, due to the nature of the materials forming the bladder and the air chambers, the fluid pressure within the bladder causes the mattress to bow outwardly along the longer of the opposed marginal edges. Such bowing is undesireable in that it adversely effects the overall appearance of the floatation sleep system.

SUMMARY OF THE INVENTION

This invention is directed to a mechanism for maintaining the shape of a floatation sleep system, such system including a bladder having flexible walls defining a chamber adapted to be filled with fluid and a marginal perimeter edge support for such bladder. The shape maintaining mechanism comprises a sheet of flexible, dimensionally stable material. The sheet is attached to the underside of the bladder along a substantial portion of opposed marginal edges so that it extends, in intimate contact, from one edge, around the adjacent marginal perimeter support, across the top portion of the bladder, around the opposite marginal perimeter support to the other edge. Such sheet is thus constrained to oppose the fluid forces on the marginal perimeter support and maintain the shape of the floatation sleep system.

The invention and its objects and advantages, will become more apparent in the detailed description of the preferred embodiment presented below.

BRIEF DESCRIPTION OF THE DRAWINGS

In the detailed description of the preferred embodiment of the invention reference is made to the accompanying drawings, in which.

DESCRIPTION OF THE PREFERRED EMBODIMENT

Figure 1:
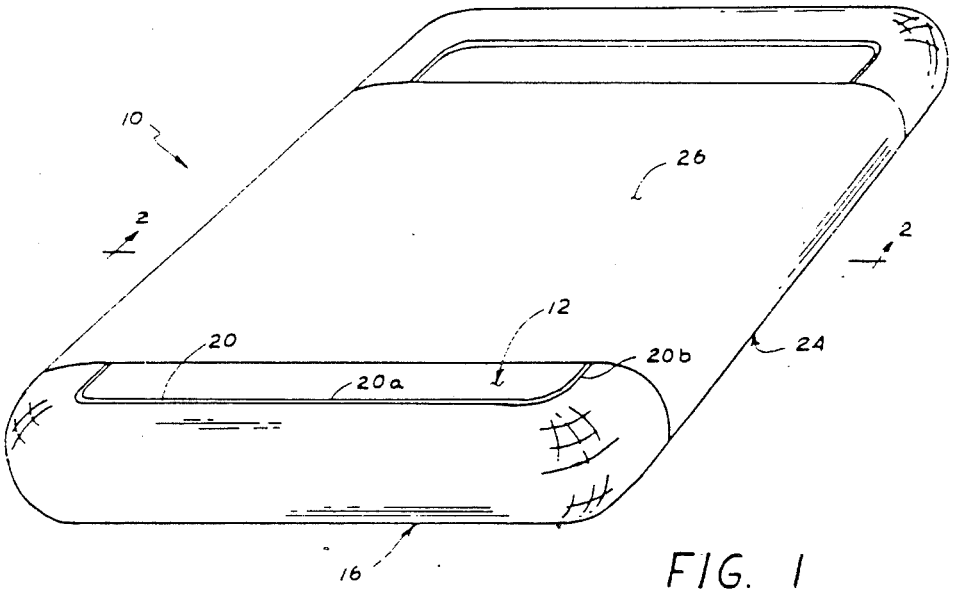
FIG. 1 is an isometric top-front view of a floatation sleep system including the shape retaining mechanism according to this invention.
Figure 2:
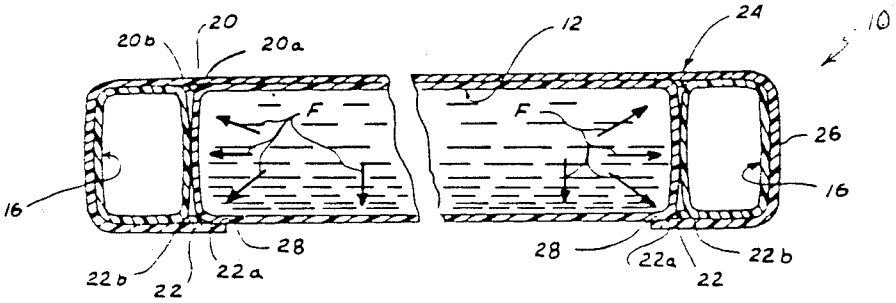
FIG. 2 is a cross-sectional view of floatation sleep system taken along the lines 2—2 of FIG. 1.

Referring now to the accompanying drawings, the floatation sleep system, or waterbed, is designated generally by the numeral 10. As best shown in FIGS. 1 and 2, the waterbed 10 includes a bladder member 12. The bladder member 12 is formed of a flexible, dimensionally stable, fluid impervious material, such as polyethylene or polypropylene for example. The bladder member is a chamber of substantially rectangular prism configuration. The bladder member 12 is filled with a fluid such as water for example. A perimeter support 16 surrounds the upstanding marginal edge of the bladder member 12. The perimeter support 16 is formed in a continuous cylinder of dimensionally stable, flexible material similar to the bladder forming material for example. The perimeter support 16 is interconnected with the bladder member 12 by segments 20, 22 of flexible, dimensionally stable material (e.g. similar to the material forming the bladder member) heat sealed along the marginal edges **20*a*, 22*a* to the bladder member 12, and along the marginal edges 20*b*, 22*b* to the perimeter support 16**.

Figure 3:
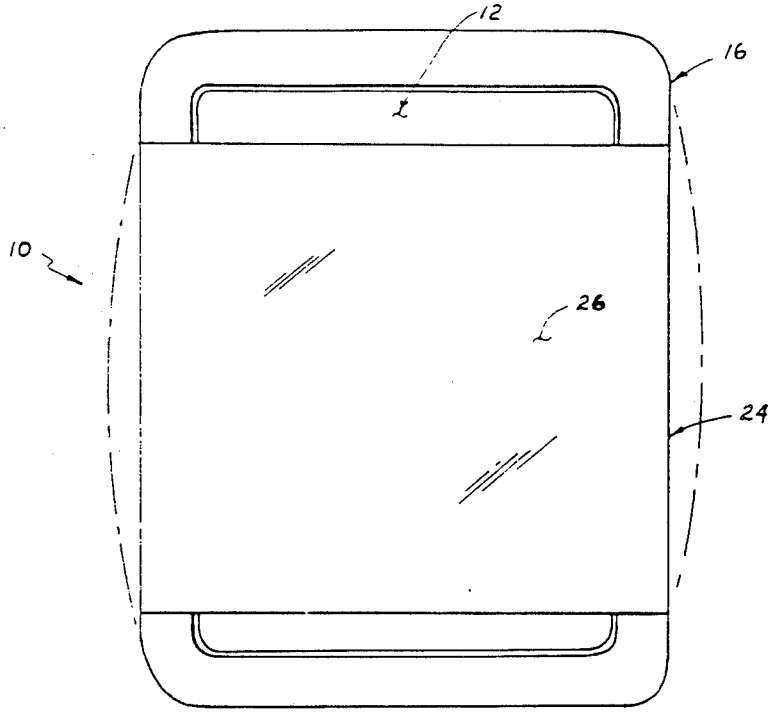
FIG. 3 is a top plan view of the floatation sleep system of FIG. 1 showing, in phantom, its configuration without the shape retaining mechanism of this invention.
Figure 4:
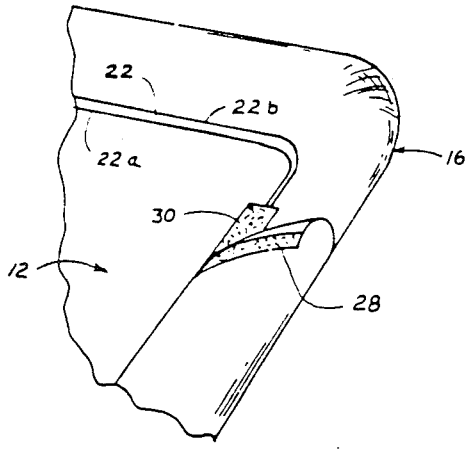
FIG. 4 is an isometric bottom-side view of a portion of the floatation sleep system of FIG. 1 showing the means for releasably attaching the shape retaining mechanism.

The fluid within the bladder member 12 exerts an outward force F on the bladder side walls. The longer of the opposed marginal side walls, being inherently weaker because of their greater extent, would bow under the liquid force to assume the configuration shown by phantom lines of FIG. 3. Such bowing would result in an undesireable shape to the waterbed 10. Therefore, the waterbed has a shape retaining mechanism 24 according to this invention. The mechanism 24 comprises a sheet 26 of flexible, dimensionally stable material, similar to the bladder forming material for example. The sheet 26 is releasably attached at opposed marginal edges to the underside of the bladder member 12. Such attachment is along a substantial portion of the longer of the opposed marginal edges of the bladder member adjacent to the edges **22*a* by matting releasable fastener members 28, 30 such as for example, strips of material known as Velcro (see FIG. 4). The sheet 26 extends, in intimate contact, from one edge, around the adjacent marginal perimeter support, across the top portion of the bladder member, around the opposite marginal perimeter support to the other edge. The dimension of the sheet 26 measured between its opposed marginal edges is substantially equal to the distance between edges of the bladder member, to which the sheet is attached, measured around the adjacent marginal perimeter supports and the top portion of the bladder member. The portion of the fluid forces opposite the strips 28, 30 acts to retain the sheet 26 in its desired location. Thus, the sheet 26 is constrained to oppose the fluid forces F on the marginal perimeter support. Therefore, the sheet 26** maintains the desireable shape of the waterbed.

The invention has been described in detail with particular reference to a preferred embodiment thereof, but it will be understood that variations and modifications can be effected within the spirit and scope of the invention.

I claim:

1. Mechanism for maintaining the shape of a floatation sleep system, such system including a bladder having flexible walls defining a chamber adapted to be filled with fluid and a marginal perimeter edge support for such bladder, said mechanism comprising:

a flexible dimensionally stable sheet; and means for attaching said sheet to opposed marginal edges of said bladder, such means including matting releasable fastener members fixed to opposed marginal edges of the underside of said bladder and opposed marginal edges of said sheet respectively, so that such sheet may extend in intimate contact from one edge, across the top portion of said bladder, around the opposite marginal perimeter support to the other edge, whereby such sheet is constrained to oppose fluid forces on the marginal perimeter support.

2. The invention of claim 1 wherein the dimension of said sheet measured between said opposed marginal edges thereof is substantially equal to the distance between said opposed marginal edges of said bladder measured around the said adjacent marginal perimeter support, top portion of said bladder, and opposite marginal perimeter support.

3. In a floatation sleep system including a bladder having flexible walls defining a chamber adapted to be filled with fluid and a marginal perimeter edge support for such bladder, the improvement comprising:

a flexible, dimensionally stable sheet, and means for releasably attaching such sheet to opposed marginal edges of said bladder on the underside thereof along a substantial portion of such edges so that such sheet extends in intimate contact from one edge, around the adjacent marginal perimeter support, across the top portion of said bladder, around the opposite marginal support to the other edge, whereby such sheet is constrained to oppose fluid forces on the marginal perimeter support to maintain the shape of such floatation sleep system.

4. The invention of claim 3 wherein said attaching means includes matting releasable fastener members respectively fixed to said opposed marginal edges of the underside of said bladder and opposed marginal edges of said sheet.

5. The invention of claim 4 wherein the dimension of said sheet measured between said opposed marginal edges thereof is substantially equal to the distance between said opposed marginal edges of said bladder measured around the said adjacent marginal perimeter support, top portion of said bladder, and opposite marginal perimeter support.

* * * * *